US005984636A

United States Patent [19]

Fähndrich et al.

[11] Patent Number: 5,984,636

[45] Date of Patent: Nov. 16, 1999

[54] COOLING ARRANGEMENT FOR TURBINE ROTOR

[75] Inventors: Marc Louis-Paul Fähndrich; Stanislaw Maciej Przybytkowski; Azizullah, all of Longueuil, Canada

[73] Assignee: Pratt & Whitney Canada Inc., Longueuil, Canada

[21] Appl. No.: 08/994,013

[22] Filed: Dec. 18, 1997

[51] Int. Cl.[6] ..... B63H 1/14; F03D 11/02; F01D 5/08

[52] U.S. Cl. ..... 416/96 R; 415/178

[58] Field of Search ..... 416/95, 96 R, 416/97 R, 179, 182; 415/115, 116, 175, 177, 178, 180

[56] References Cited

U.S. PATENT DOCUMENTS

| | | | |
|---|---|---|---|
| 3,490,852 | 1/1970 | Carlstrom et al. . | |
| 3,572,966 | 3/1971 | Borden et al. . | |
| 3,635,586 | 1/1972 | Kent et al. | 416/97 R X |
| 3,644,058 | 2/1972 | Barnabei et al. . | |
| 3,748,060 | 7/1973 | Hugoson et al. . | |
| 3,814,539 | 6/1974 | Klompas | 416/95 |
| 3,989,410 | 11/1976 | Ferrari . | |
| 4,674,955 | 6/1987 | Howe et al. | 416/95 |
| 4,759,688 | 7/1988 | Wright et al. | 416/95 |
| 4,820,116 | 4/1989 | Hovan et al. | 415/115 |
| 4,854,821 | 8/1989 | Kernon et al. | 416/95 |
| 5,143,512 | 9/1992 | Corsmeir et al. | 416/96 R X |
| 5,173,024 | 12/1992 | Mouchel et al. . | |
| 5,310,319 | 5/1994 | Grant et al. | 416/95 X |
| 5,816,776 | 10/1998 | Chambon et al. | 416/95 X |

FOREIGN PATENT DOCUMENTS

| | | |
|---|---|---|
| 837575 | 11/1957 | United Kingdom . |
| 1410658 | 12/1972 | United Kingdom . |

OTHER PUBLICATIONS

CFD–Analysis of Coverplate Receiver Flow, MTU München 1996, The American Society of Mechanical Engineers.

Simulation of the Secondary Air System of Aero Engines, K.J. Kentz, T.M. Speer, Journal of Machinery, Apr. 1996, ASME.

MTR390, The New Generation Turboshaft Engine, Aug. Spirkl, MTU München, Germany, AGARD, Mar. 1994.

*Primary Examiner*—John E. Ryznic
*Attorney, Agent, or Firm*—Jeffrey W. Astle

[57] ABSTRACT

A cooling arrangement for a bladed rotor in a gas turbine engine, wherein each of the blades includes cooling air passages and a cover with curved fins is mounted adjacent to but connected to the rotor and spaced apart slightly from the rotor disc to form a passageway for the cooling fluid. The cooling arrangement includes a tapered, conically shaped inlet formed in the cooling passage which then diverges to form a diffuser near the outer end of the passageway. The cover includes an enlarged inner portion and a thin outer wall portion beyond the free ring diameter. A hammerhead is formed at the outer periphery of the cover whereby the hammerhead will move closer to the disc in response to centrifugal forces, thus sealing the passage.

4 Claims, 5 Drawing Sheets

COOLING ARRANGEMENT FOR TURBINE ROTOR

BACKGROUND OF THE INVENTION

1. Field of the Invention

This invention is directed toward an improved rotor assembly for a gas turbine. The invention is more particularly directed toward an improved cooling arrangement for the rotor assembly in a gas turbine.

2. Description of the Prior Art

Cooling arrangements for the rotor assemblies in gas turbines engines are known. However, there is always room to improve the cooling arrangements in order for the gas turbines to operate more efficiently at high temperatures. The known cooling arrangements include providing a rotor cover for the rotor of the rotor assembly, the cover spaced slightly from the upstream side of the rotor to form a disk-shaped cooling passage that directs cooling air from an annular area close to the axis of rotation of the rotor and cover to the peripheral edge of the rotor cover from where it is directed to the roots of the blades on the rotor. Examples of such cooling arrangements are shown in U. S. Pat. Nos. 4,674,955, issued Jun. 23, 1987 to Owe et al and 4,820,116, issued Apr. 11, 1989 to Hogan et al, by way of example. The cooling passage, however, is not well designed for directing the cooling air at maximum pressure to the blades.

SUMMARY OF THE INVENTION

It is an aim of the present invention to provide an improved cooling arrangement for the rotor in a gas turbine.

It is a further aim of the present invention to provide an optimized disc and cover plate combination wherein the cover plate has a shape and curved fins are provided on the cover plate to allow the turbine to operate more efficiently at higher temperatures.

The cooling arrangement comprises new design principles to maximize the pressure rise of the cooling air as it is delivered to the blade cooling passages. Air is thus efficiently fed to the blades. The air remains cooler and effectively reduces blade metal temperature. This allows the engine to operate at higher temperatures.

In addition, the improved cooling arrangement results in a lighter and stronger rotor assembly making the turbine more efficient.

In accordance with the present invention, an improved cooling arrangement for a bladed rotor in a gas turbine wherein the blades include cooling air passages, comprises a cover mounted for rotation with the rotor adjacent but spaced from the rotor to form a cooling air inlet. The design includes providing a tapered inlet to the cooling passage formed between the cover and the rotor, which passage leads to the blades. The design includes radial fins on the cover, curved circumferentially to match the relative velocity of the air at the entry and provide efficient pressure increase of the cooling flow. The tapered inlet increases the velocity of the cooling air through the passage to minimize incidence loss at the fin leading edge.

The design also includes providing an outer radial portion of the cover which is shaped to tend to straighten due to centrifugal force as the cover rotates. The straightening effect causes the outer edge of the cover to bear tightly against the rotor, thus minimizing cooling air leakage from the cooling passage and ensuring maximum cooling air flow to the blades which further enhances cooling of the blades.

The invention in one embodiment is particularly directed toward a rotor assembly for a gas turbine comprising a rotor, a set of turbine blades mounted by their roots on the rim of the rotor, and rotor cooling passages leading from the bore of the rotor to the roots of the blades. A rotor cover is mounted adjacent the rotor on its upstream side for rotation with the rotor, the cover spaced from the rotor to define a main cooling passage for directing cooling air outwardly radially to the rotor cooling passages. The inner radial portion of the main cooling passage tapers in width from its inlet.

The invention in another embodiment is particularly directed toward a rotor assembly for a gas turbine comprising a rotor, a set of turbine blades mounted by their roots on the rim of the rotor, and rotor cooling passages leading from the bore of the rotor to the roots of the blades. A rotor cover is mounted adjacent the rotor on its upstream side for rotation with the rotor, the cover spaced from the rotor to define a main cooling passage for directing cooling air outwardly radially to the rotor cooling passages. The outer radial section of the cover is curved slightly and includes a hammerhead upstream to have its center of gravity upstream from its point of attachment to the remainder of the cover. The outermost portion of the outer radial section has a lip that is turned downstream to lie adjacent the rotor whereby, when the cover rotates with the rotor, centrifugal force will tend to straighten the outer section of the cover causing the lip to abut tightly against the rotor to seal the main cooling passage.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
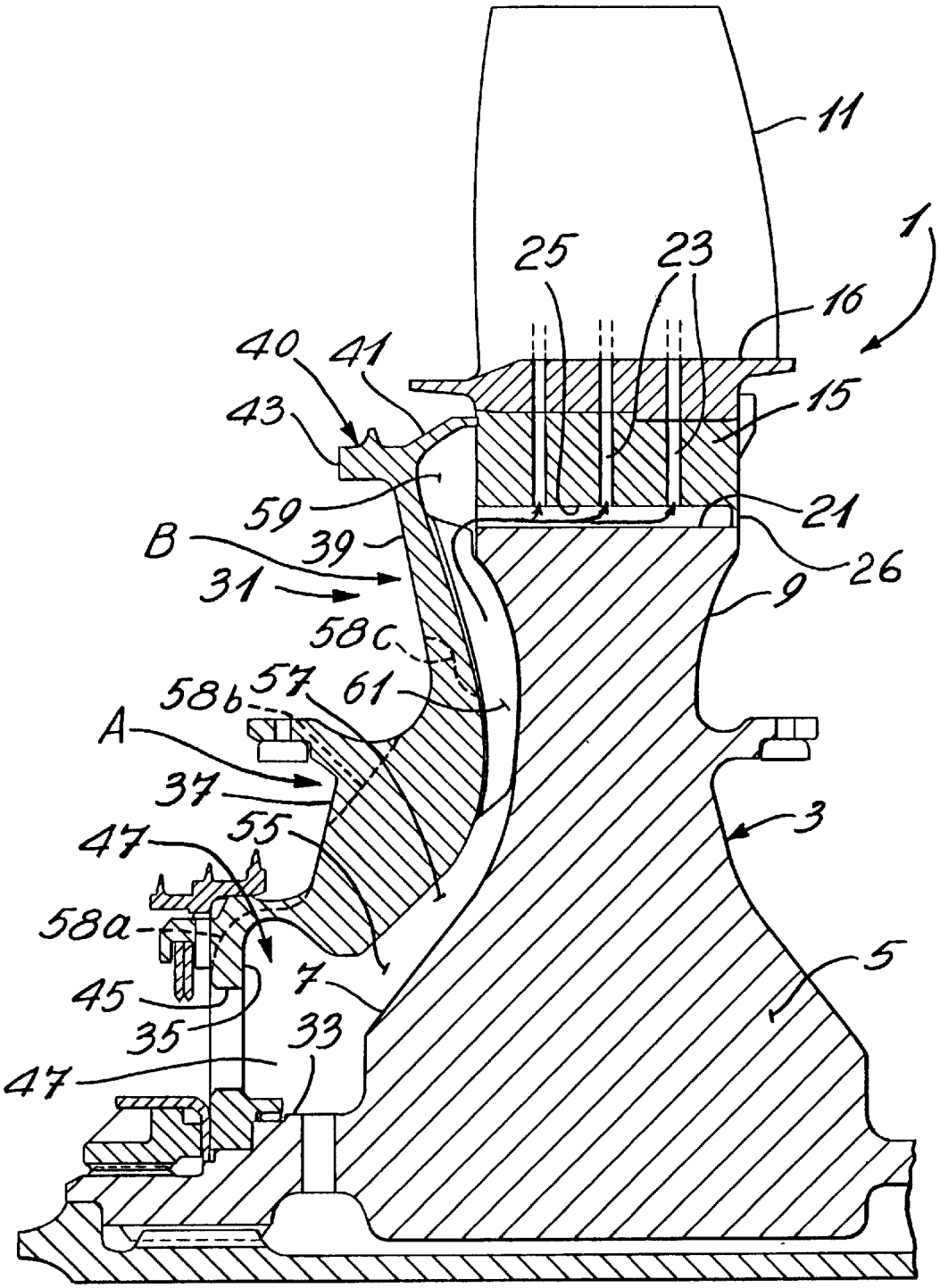
FIG. 1 is a partial, axial cross-section of a gas turbine rotor with an attached cover showing an air cooling channel.
Figure 2:
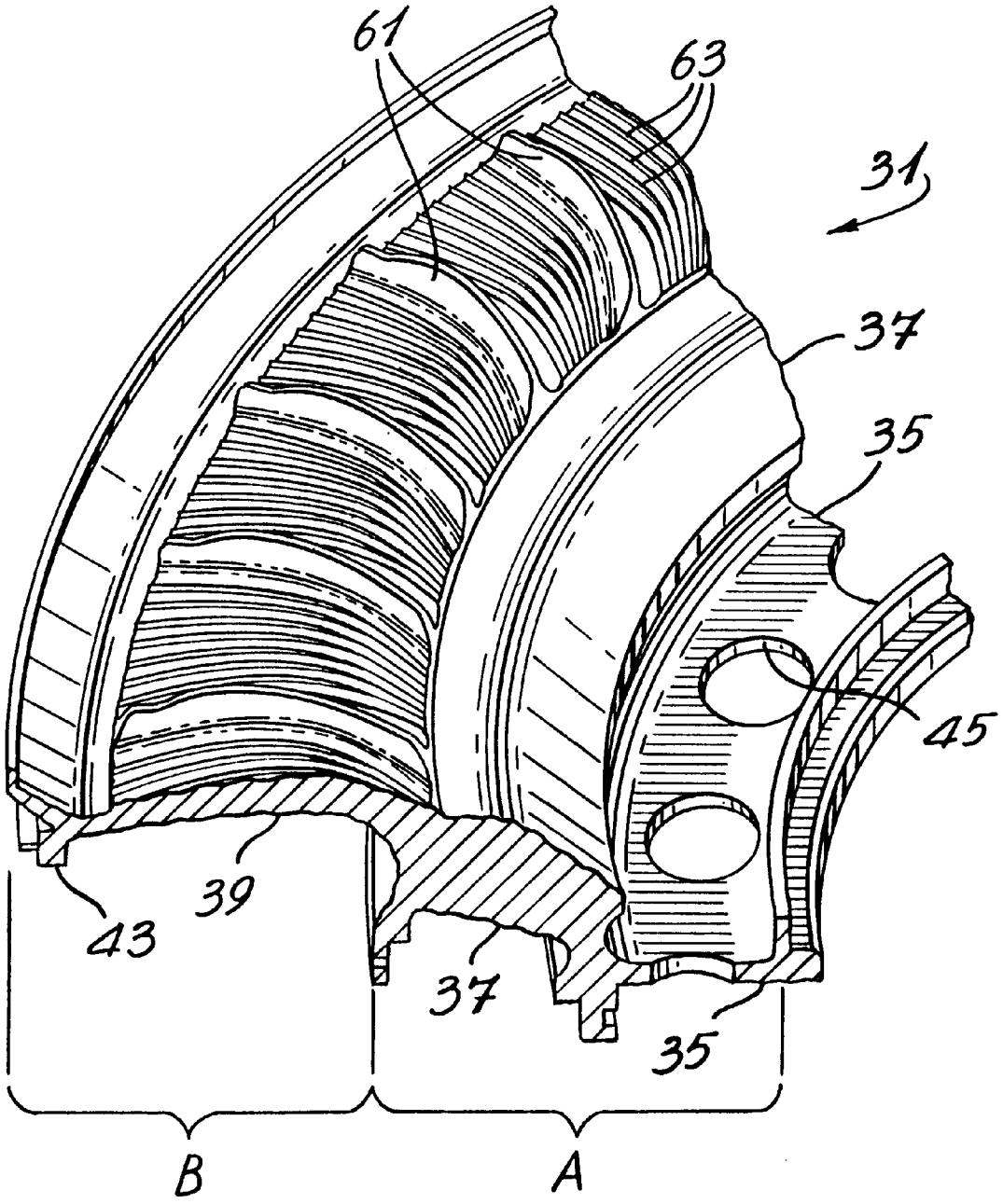
FIG. 2 is a perspective detail view of the downstream side of the rotor cover.
Figure 3:
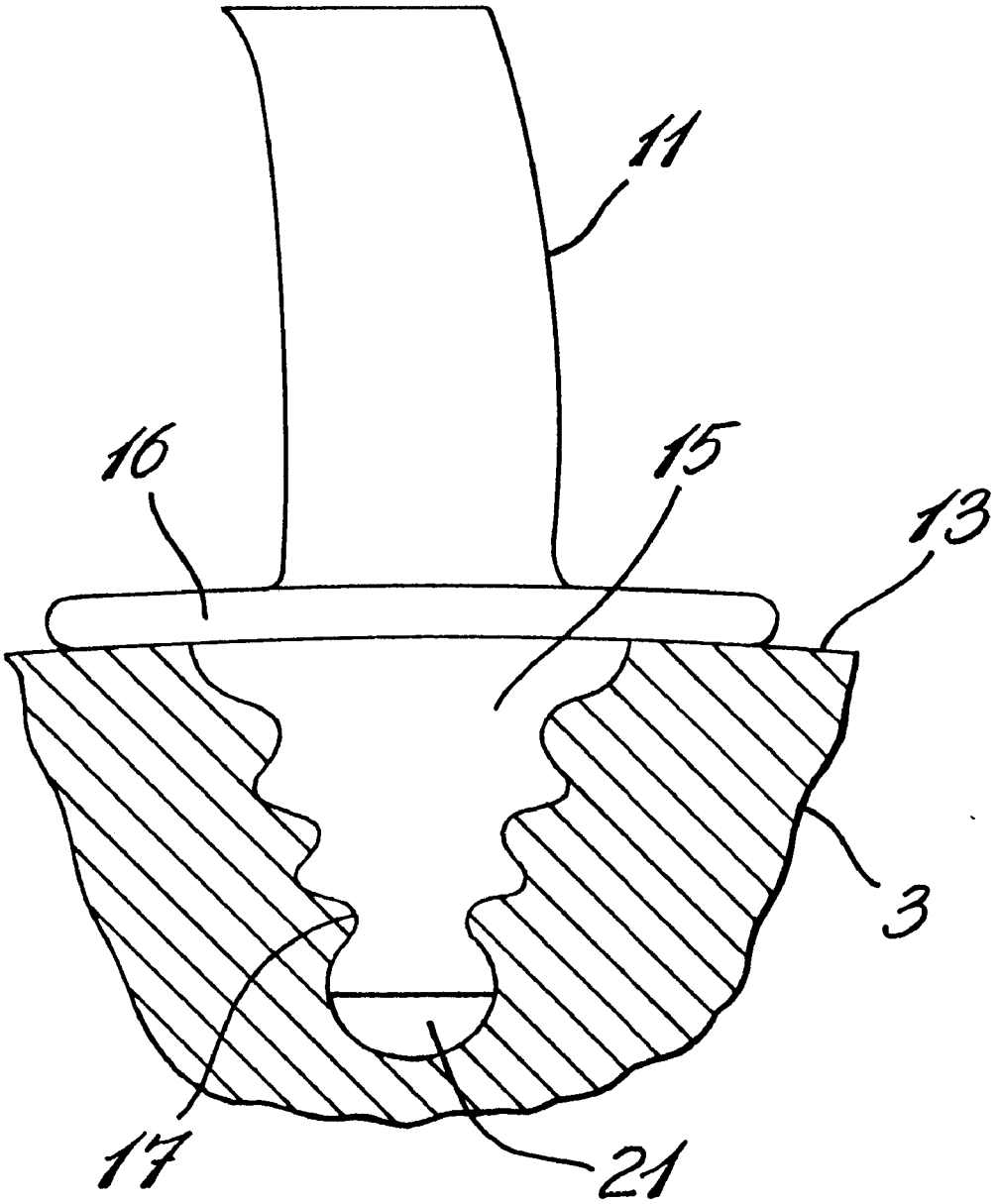
FIG. 3 is an enlarged fragmentary cross-sectional radial view of a detail of the blade assembly.

As shown in FIGS. 1 and 3, the rotor assembly 1 has a rotor 3 with a main body portion 5 defined between radially extending upstream and downstream faces 7, 9. A set of turbine blades 11 (one only shown) are mounted on the periphery of rim 13 of the rotor 3 to extend radially outwardly therefrom. The root 15 of each blade 11 is mounted in a slot 17 in the rim of the rotor 3 as is well known. The root 15 terminates at the blade platform 16.

A rotor cooling passage 21 in the rotor 3, adjacent its rim 13, directs cooling air to each turbine blade 11. There is one rotor cooling passage 21 for each blade, the passage 21 located at the bottom of the slot 17. The passage 21 in rotor 3 extends in a direction normal to a line of radius taken from the rotational axis of the rotor 3, between the upstream and downstream faces 7, 9 of the rotor 3. Blade cooling passages 23 extend radially into the blade from the root end 25 of the blade root 15 to direct cooling air from rotor cooling passage 21 into the blade to cool it. Flange 26 extends from blade root 15 to seal rotor cooling passage 21 near the downstream face 9 of rotor 3.

A rotor cover 31 is mounted upstream of the rotor 3 to rotate with it. The cover 31 is mounted on an upstream extending, cylindrical portion 33 of the rotor 3, the cylindrical portion 33 having a small radius compared to the radius of the main body portion 5 of the rotor. The cover 31 has a relatively thin, inner, wall section 35 spaced upstream from the upstream face 7 of the rotor and extending radially from the cylindrical portion 33.

The cover 31 is divided radially in two regions A and B. The lower area is designed as large as permitted by surrounding hardware to provide the maximum radial strength. The upper area is made as thin as possible to minimize centrifugal and thermal loading. The boundary between the two areas is chosen to be the diameter at which the circumferential stress in the cover plate is equal to the circumferential stress of a thin free ring of the same diameter. This free ring natural diameter is thus the diameter at which the radial growth of the disk-like cover is equal to the growth of a free ring, with equivalent material properties at the same diameter, temperature, and rotational speed.

The first portion A of the cover comprises the inner and intermediate wall sections 35, 37 of the cover. The intermediate wall section 37 of first region A is designed to be as thick as possible and limited only by the surrounding hardware in the gas turbine to reduce bore stress, to minimize bending of the inner portion of the cover due to centrifugal stress, and to provide the maximum radial strength.

The second portion B of the cover comprises the outer wall section 39, and this section is designed to be as thin as possible over a major portion of its length, allowing it to bend under centrifugal force to seal the passage and to minimize centrifugal and thermal loading. The reduction in weight of the outer wall section 39 is significantly greater than the increase in weight in the intermediate wall section 37 thereby reducing the overall weight of the cover. The bending of the outer wall section also ensures that curved fins 61 (detailed below) fit tightly within the passage, thus maximizing delivery pressure of the cooling air to the blades.

In order to determine the self-sustaining radius corresponding to the free ring diameter 58*a, b, c,* one must first obtain a plot of radial growth vs. Radius for a free ring using the following equation:

$$\delta_{rad}=\rho r^3\omega^2/(Ed)+r\alpha\Delta T$$

where $\delta_{rad}$= radial growth (in.)

$\rho$= density (lbs./in$^3$)

r= radius (in.)

$\omega$= rotational speed (rad/s)

E= modulus of elasticity (lbs/in$^2$)

g= gravitational constant (in/s$^2$)

$\alpha$= coefficient of thermal expansion (°F$^{-1}$)

T= temp (°F).

The radial thermal growth corresponding to the temperature at each radius must be added to the free ring growth equation. It is also noted that the presence of externally applied loads or loads due to a radial thermal gradient do not affect the free ring growth equation. The plot of radial growth vs. radius for a free ring must then be compared to a plot of radial growth vs. radius for the disk being analyzed. The radius at which these two curves intersect (i.e., the radius at which the radial growths are equivalent) is the self-sustaining radius or free ring diameter 58*a, b, c.* The self-sustaining radius is not constant along the axis of rotation of the part. First and second portions A and B are separated by a curve which is the sum of all the local self-sustaining radii.

As previously mentioned, the cover 31 includes a relatively thick, intermediate, wall section 37 which extends axially toward the main body of the rotor and radially outwardly from the outer end of the inner wall section 35 and within the free ring diameter. The cover further includes a relatively thin, outer, wall section 39 that extends radially from the top, downstream side of the intermediate wall section 37. The thin portion 39 is outboard of the free ring diameter 58*c.* A hammerhead 40 having a lip 41 is provided on the outer peripheral edge of the outer wall section 39. The hammerhead 40 is enlarged in the upstream direction, as shown at 43. The lip 41 extends generally in an axial, downstream, direction to lie closely adjacent to the upstream face 7 of the rotor 3 just above the rotor cooling passage 21.

The rotor cover 31 has circumferentially spaced-apart, circular, cooling air inlet openings 45 in the inner wall section 35. The inlet openings 45 direct cooling air into an annular bore or chamber 47 defined by: a portion of the cylindrical portion of the rotor 3; the downstream surface of the inner wall section 35; the inner surface of the intermediate wall section 37; and the upstream face 7 of the rotor 3. The chamber 47 leads to a main cooling passage 55 defined between the intermediate and outer wall sections 37, 39 of the cover 31 and a major portion of the upstream face of the rotor 3. This main cooling passage 55 has an inner portion 57 that extends slightly downstream and radially outwardly, the inner portion 57 being roughly half the length of the passage, and an outer portion 59 that curves slightly upstream and then back downstream to the rotor cooling passage 21.

Curved fins 61 are provided on the downstream face of the rotor cover 31 extending over part of the intermediate and outer wall sections 37, 39, the curved fins positioned mainly in the outer portion 59 of the cooling passage 55. The curved fins 61 are circumferentially spaced apart, and smaller ribs 63 can be provided between each adjacent pair of curved fins 61. The curved fins 61 and ribs 63 provide a pumping action to the air flowing through the main cooling passage 55.

In accordance with the present invention, the inner portion 57 of the cooling passage 55 tapers gradually inwardly from the annular chamber 47 to the outer portion 59. This construction reduces the area through the passage for the cooling air thereby increasing its velocity and thus eventually ensuring better cooling of the blades 5.

Figure 4:
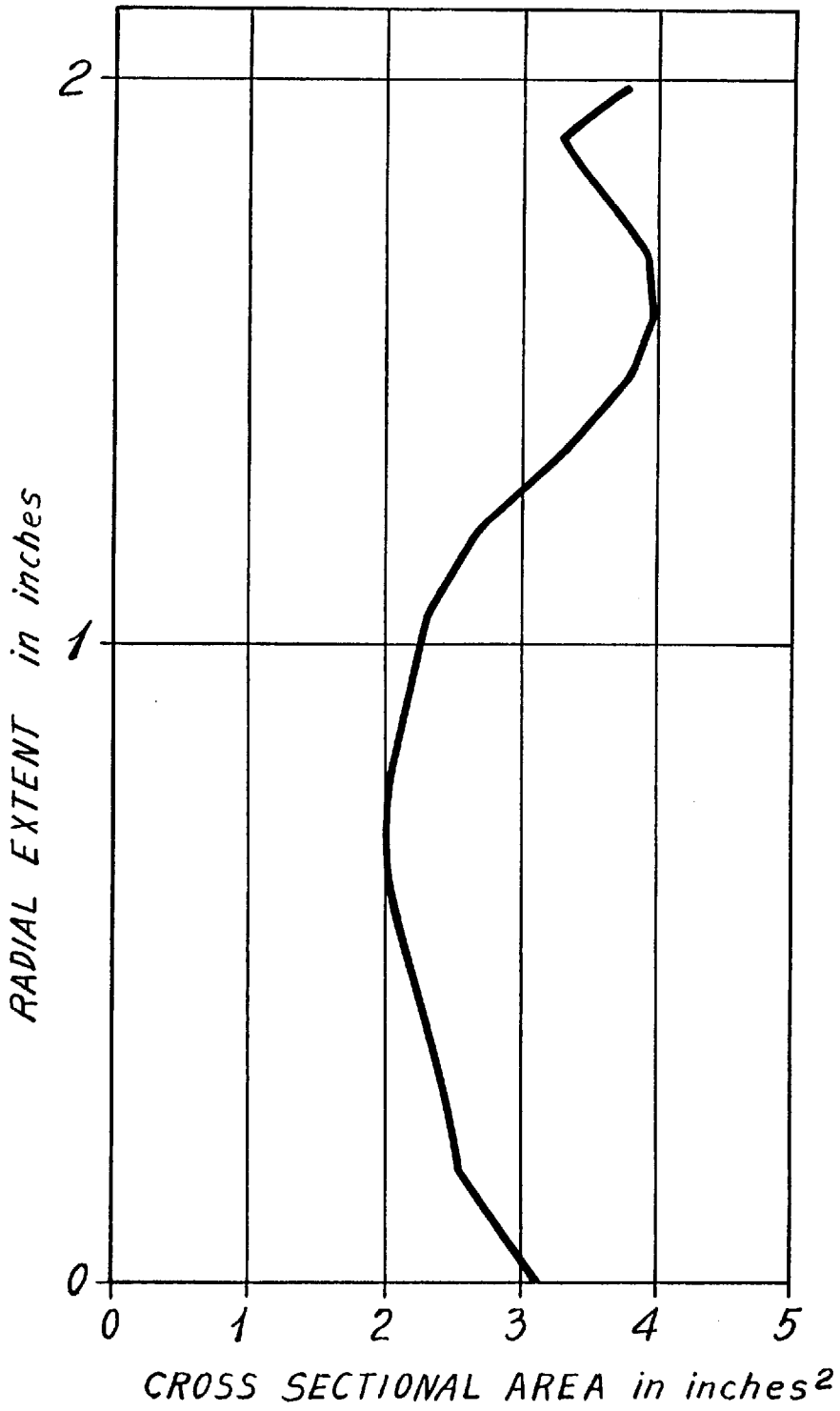
FIG. 4 is a diagram on which the cross-sectional area of the passage is plotted against the radial extent thereof.

FIG. 4 is a graph on which the cross-sectional area normal to the cone-shaped passageway 55 is plotted against the radial distance from the chamber 47. As can be seen, the passageway becomes more constricted as the radius increases but then forms a diffuser towards the ends of the curved fins 61.

Figure 5:
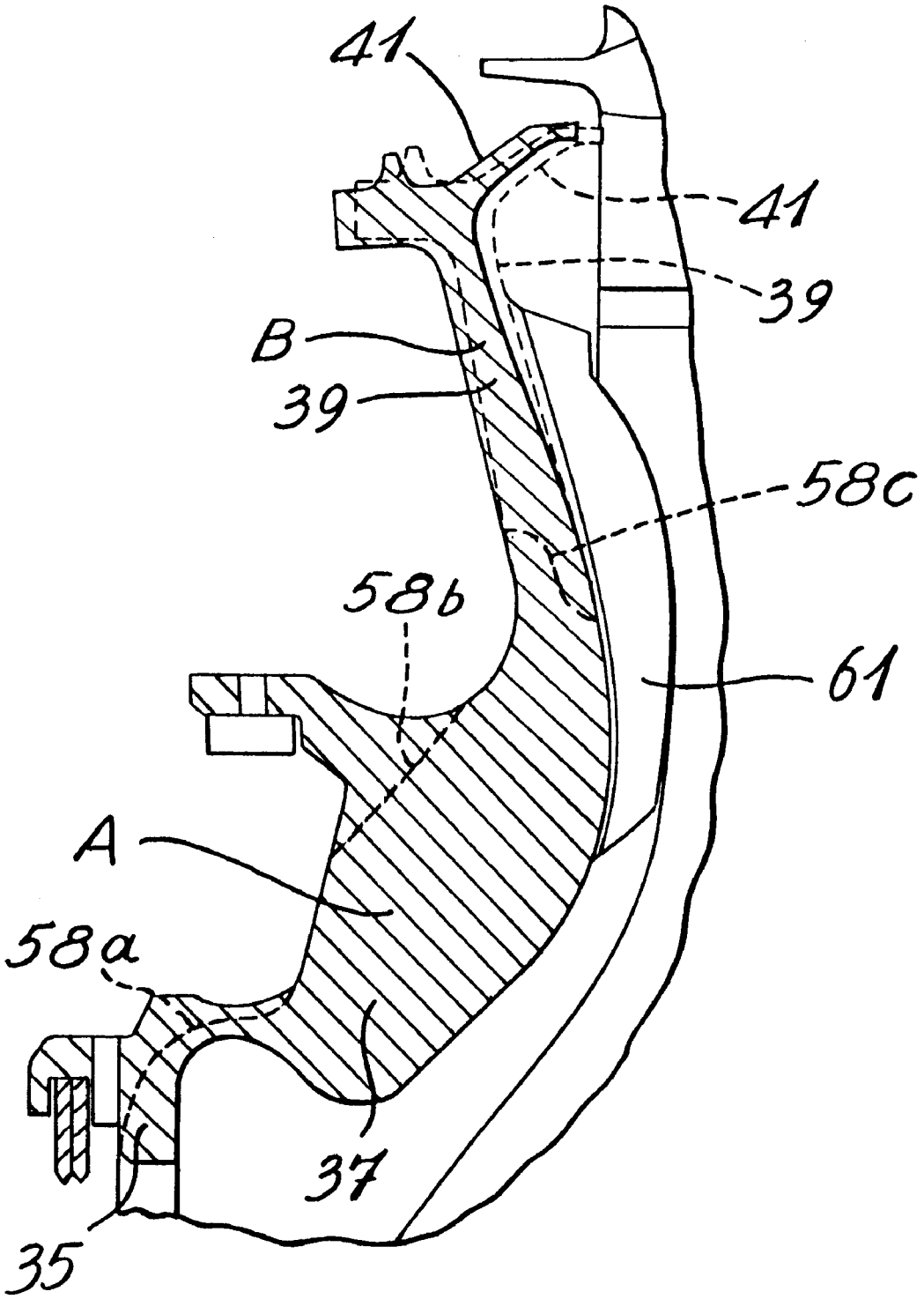
FIG. 5 is a cross-sectional view, similar to FIG. 1, showing the cover plate in relation to the disc.

Also in accordance with the present invention, the outer wall section 39 of the cover 31 curves in an upstream direction from the free ring diameter 58c, thus locating its center of gravity slightly downstream from its point of attachment to the intermediate wall section 37. This construction allows centrifugal force to tend to straighten the outer wall section 39 causing it to bend toward the rotor and thus causing the free end of the lip to tightly abut against the rotor above the rotor cooling passage to seal the upper end of the main cooling passage 55. This is shown more clearly, but exaggerated, in FIG. 5. The hammerhead 40 and lip 41 are shown, in dotted lines, bent towards the rotor. Thus, leakage of the cooling air is minimized and pressure is maintained.

In operation, cooling air is directed toward the rotor 3 through the inlet openings 45 into the annular chamber or bore 47 and then into the inner portion 57 of the main cooling passage 55 where it is compressed increasing its pressure. The cooling air flows through the main cooling passage 55 to the rotor cooling passages 21, the curved fins 61 and ribs 63 helping the air move through the passage. As the rotor and attached cover rotate, centrifugal force causes the outer wall section 39 of the cover 31 to straighten slightly forcing the lip 41 of the hammerhead 40 into contact with the rotor 3 above the rotor cooling passages 21 so as to seal the upper end of the main cooling passage 55 and minimize leakage of the cooling air. The pressure of the cooling air is maintained passing into the rotor cooling passages 21 and into the cooling passages 23 in the blades 11 to provide more efficient cooling.

The construction of the cover provides high pumping efficiency with low stress and reduced weight. This is achieved by dividing the cover 31 radially into a first portion which is within the free ring natural diameter of the cover and a second portion which is outside the free ring natural diameter of the cover.

We claim:

1. A rotor assembly for a gas turbine comprising: a rotor having an annular rim, a set of turbine blades mounted by their roots on the rim of the rotor, the blades having blade cooling passages and passage inlets at the respective roots, rotor cooling passages leading from the rim of the rotor to the passage inlets at the roots of the blades, a rotor cover having a free ring diameter and a radially outermost portion mounted on the rotor adjacent its upstream side for rotation with the rotor, the cover spaced from the rotor to define a main cooling passage for directing cooling air outwardly radially to the passage inlets, the cover having an outer radial section, outboard of the free ring diameter, curved slightly upstream to have its center of gravity upstream from its point of attachment to the remainder of the cover, radially extending vanes on the downstream side of the rotor cover, the outermost portion having a lip that is turned downstream to lie adjacent the rotor whereby, when the cover rotates with the rotor, centrifugal force will tend to straighten the outer radial section of the cover causing the lip to abut tightly against the rotor to seal the main cooling passage and the vanes maximize the pumping action of the cooling air through the main cooling passage.

2. A rotor assembly for a gas turbine comprising: an annular rotor having a rotor disc with an axial bore and an outer periphery, a set of turbine blades each having an airfoil and a blade root, the blades being mounted by their roots on the outer periphery of the rotor disc, each blade having blade cooling passages and a passage inlet at the root, a main cooling passage leading radially from the bore of the rotor disc to the passage inlets at the roots of the blades, a rotor cover mounted adjacent the rotor disc for rotation with the rotor disc, the rotor cover spaced front the rotor disc to define said main cooling passage for directing cooling air outwardly radially to the passage inlets, the inner radial portion of the main cooling passage tapering in width from its inlet throughout the inner radial portion of the main cooling passage; the rotor cover having a free ring diameter and a relatively thin inner wall section and a relatively thick intermediate wall section within the free ring diameter; and a relatively thin outer wall section outboard of the free ring diameter, the outer wall section bent away from the rotor and from its point of attachment to the intermediate wall section to locate its center of gravity away from the rotor and from its point of attachment; radially extending vanes on the rotor side of the rotor cover, the vanes extending over a portion of the intermediate wall section and a portion of the outer wall section, whereby centrifugal force will tend to straighten the outer wall section when the rotor and the cover rotate maximizing pumping action of the cooling air through the main cooling passage by the vanes.

3. The rotor assembly as claimed in claim 1, wherein the inner radial portion of the main cooling passage comprises about half the length of the passage.

4. The rotor assembly as claimed in claim 2, wherein the outer wall section has a lip at an outer edge thereof extending toward the rotor disc, the lip located radially outwardly of the main cooling passages and contacting the rotor disc when the rotor and cover rotate to seal the main cooling passage.

* * * * *